US005608296A

United States Patent [19]

Brown

[11] Patent Number: 5,608,296

[45] Date of Patent: Mar. 4, 1997

[54] MULTIPLE PULSING THROUGHOUT THE GLOW MODE

[75] Inventor: Allan E. Brown, Palatine, Ill.

[73] Assignee: Philips Electronics North America Corp., New York, N.Y.

[21] Appl. No.: 639,042

[22] Filed: Apr. 16, 1996

Related U.S. Application Data

[63] Continuation of Ser. No. 386,904, Feb. 7, 1995, abandoned, which is a continuation-in-part of Ser. No. 283,110, Jul. 29, 1994, Pat. No. 5,453,666, which is a continuation-in-part of Ser. No. 980,831, Nov. 24, 1992, Pat. No. 5,430,354, which is a continuation-in-part of Ser. No. 856,771, Mar. 24, 1992, Pat. No. 5,256,946.

[51] Int. Cl.[6] ..... H05B 37/02

[52] U.S. Cl. ..... 315/289; 315/307

[58] Field of Search ..... 315/289, 290, 315/307

[56] References Cited

U.S. PATENT DOCUMENTS

| | | | |
|---|---|---|---|
| 4,678,968 | 7/1987 | Lester | 315/290 |
| 4,695,771 | 9/1987 | Hallay | 315/290 |
| 4,939,430 | 7/1990 | Droho | 315/291 |
| 5,013,977 | 5/1991 | Droho | 315/290 |
| 5,051,664 | 9/1991 | Droho | 315/278 |
| 5,051,665 | 9/1991 | Garrison et al. | 315/287 |

FOREIGN PATENT DOCUMENTS

| | | | |
|---|---|---|---|
| 0044080 | 4/1977 | Japan | 315/289 |

*Primary Examiner*—Robert Pascal
*Assistant Examiner*—Michael B. Shingleton
*Attorney, Agent, or Firm*—Edward Blocker

[57] ABSTRACT

An ignition scheme for starting a high intensity discharge lamp requiring energy in the form of ignition pulses to be provided to the lamp prior to and substantially throughout the glow load of the lamp. An ignitor includes a bilateral switching device such as, but not limited to, a SIDAC having a breakover voltage corresponding to the lamp voltage during the lamp glow mode. The ignition scheme substantially eliminates the lamp remaining in its glow mode for a prolonged period of time thereby minimizing the possibility of lamp destruction from damage to the lamp electrodes.

9 Claims, 1 Drawing Sheet

MULTIPLE PULSING THROUGHOUT THE GLOW MODE

CROSS-REFERENCE TO RELATED APPLICATIONS

This is a continuation of application Ser. No. 08/386,904, filed Feb. 7, 1995, now abandoned, which is a continuation-in-part of U.S. patent application Ser. No. 08/283,110, filed Jul. 29, 1994 now U.S. Pat. No. 5,453,666, which is a continuation-in-part of U.S. patent application Ser. No. 07/980,831, filed Nov. 24, 1992 now U.S. Pat. No. 5,430,354, which is a continuation-in-part of U.S. patent application Ser. No. 07/856,771, filed Mar. 24, 1992, which has issued as U.S. Pat. No. 5,256,946 on Oct. 26, 1993.

BACKGROUND OF THE INVENTION

This invention relates generally to a high intensity discharge (HID) lamp ballast and, more particularly, to an ignition scheme for starting an HID lamp.

An HID lamp generally refers to a family of lamps including high pressure mercury, high pressure sodium, metal halide and low pressure sodium. A conventional ballast for powering an HID lamp includes an ignitor. The ignitor provides high voltage ignition pulses applied to the lamp for starting the latter.

The energy from the high voltage pulses generated by the ignitor are provided to the lamp prior to the lamp entering its glow mode. At the time that the lamp begins to enter its glow mode, the ignitor is shut off. No high voltage pulses are generated during the glow mode. When ignition is successful, the lamp proceeds rapidly through the glow mode to a steady state condition, that is, from a glow discharge to an arc discharge condition between the lamp's electrodes.

The amount of energy required for successful ignition varies and depends on factors such as, but not limited to, partial pressures of the gasses within the lamp. When an insufficient amount of energy is delivered to the HID lamp to ignite the latter, the lamp can become stuck in its glow mode and never reach a steady state (full arc) condition.

Repeated exposure to prolonged periods within the glow mode can damage the HID lamp electrodes. Destruction of the lamp can result.

Accordingly, it is desirable to provide an improved HID ballast having a more reliable HID ignition scheme. The ignition scheme, in particular, should avoid prolonged periods of time within the glow mode.

SUMMARY OF THE INVENTION

Generally speaking, in accordance with a first aspect of the invention, a ballast for lighting a high intensity discharge lamp having a glow mode includes output terminals and an ignitor for producing ignition pulses prior to and at least substantially throughout the glow mode of a high intensity discharge lamp. The ignitor includes a voltage sensor for sensing the voltage across the output terminals and is responsive to the voltage sensor in its production of ignition pulses.

The lamp avoids remaining within the glow mode for an extended period of time by producing ignition pulses not only prior to but also substantially throughout the glow mode of the high intensity discharge lamp. The ignition pulses produced prior to and substantially throughout the glow mode provide sufficient energy for successful takeover, that is, for the lamp to move from a glow discharge to arc discharge operating condition. Damage of the lamp electrodes and consequent lamp destruction based on prolonged duration within the glow mode during start-up is substantially eliminated.

Preferably, the ignitor includes a bilateral switching device such as, but not limited to, a SIDAC having a breakover voltage corresponding to the level of voltage expected across the lamp during its glow mode. The ignitor also can include a capacitor coupled to the bilateral switching device and through which the capacitor discharges at breakover of the bilateral switching device.

In accordance with another aspect of the invention, a lighting arrangement includes an HID lamp having a glow mode and an ignitor for producing ignition pulses prior to and at least substantially throughout the glow mode of the HID lamp.

In accordance with yet another aspect of the invention, a method for starting a high intensity discharge lamp includes the steps of producing ignition pulses prior to the lamp entering its glow mode, continuing to produce ignition pulses substantially throughout the glow mode of the lamp and discontinuing the production of ignition pulses after transition to full arc discharge. The method typically also includes sensing the voltage across the ignitor in determining when to produce the ignition pulses and when to discontinue production of the ignition pulses.

Accordingly, it is an object of the invention to provide an improved ignition scheme for more reliably starting an HID lamp.

It is another object of the invention to provide an improved HID ballast which provides sufficient energy to the HID lamp so as to avoid the latter remaining in its glow mode for a prolonged period of time during start up.

Still other objects and advantages of the invention, will, in part, be obvious, and will, in part, be apparent from the specification.

The invention accordingly comprises several steps in the relation of one or more such steps with respect to each of the others, and the device embodying features of construction, combination of elements and arrangements of parts which are adapted to effect such steps, all is exemplified in the following detailed disclosure, and the scope of the invention will be indicated in the claims.

BRIEF DESCRIPTION OF THE DRAWING

For a fuller understanding of the invention, reference is had to the following descripion taken in connection with the accompanying drawing in which.

DETAILED DESCRIPTION OF THE PREFERRED EMBODIMENT

Figure 1:
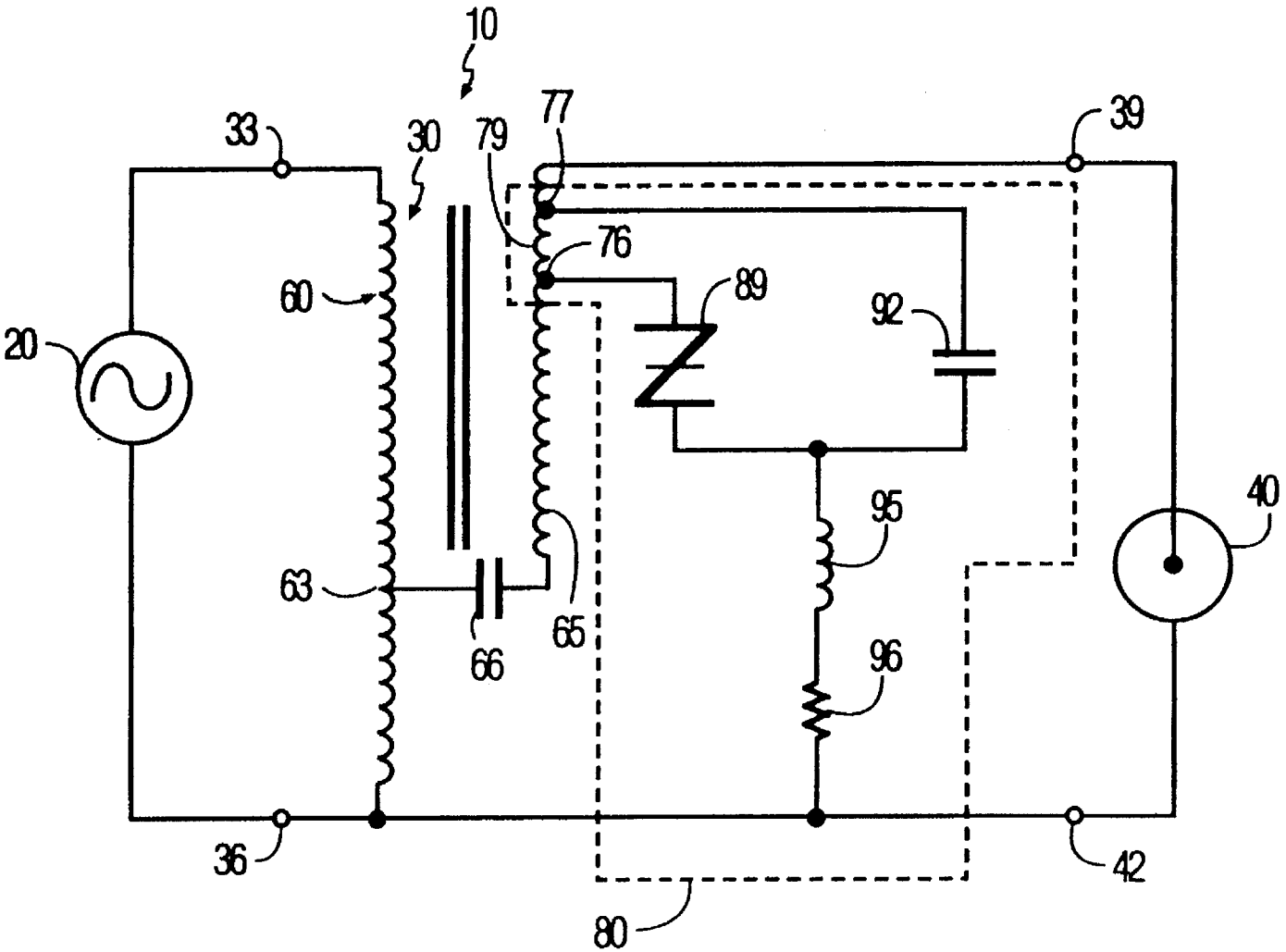
FIG. 1 is a lighting system in accordance with the invention.

As shown in FIG. 1, a ballast 10 is connected through a pair of input terminals 33 and 36 to an A.C. source 20. Ballast 10 provides power through a pair of output terminals 39 and 42 to an HID lamp 40.

Ballast 10 includes an autotransformer 60 having a primary winding 60 with a tap 63. Winding 60 is connected to input terminals 33 and 36. A capacitor 66 is connected between tap 63 and one end of a ballast winding 65. Ballast winding 65 which is magnetically coupled to primary winding 60 includes a first tap 76 and a second tap 77. The portion of ballast winding 65 between taps 76 and 77 is commonly referred to as an ignitor winding 79. The other end of ballast winding 65 is connected to output terminal 39.

Ballast winding 65 serves to limit/control the level of current flowing through lamp 40 when the latter is lit. A SIDAC 89 and a capacitor 92 are connected respectively to taps 76 and 77. SIDAC 89 and capacitor 92 are also connected through the serial combination of an inductor 95 and a resistor 96 to the junction joining primary winding 60, input terminal 36 and output terminal 42 together. Ignitor winding 79, SIDAC 89, capacitor 92, inductor 95 and resistor 96 serve together as an ignitor (i.e., starting circuit) 80. Ignitor 80 can be integrally connected to ballast winding 79. Alternatively, SIDAC 89 and capacitor 92 can be detachably connected to tap points 76 and 77, respectively.

Ballast 10 operates as follows. Power is supplied from A.C. source 20 to input terminals 33 and 36 of ballast 10. The voltage produced by A.C. source 20 is insufficient to ignite/start lamp 40, the latter of which requires ignition (starting) pulses. The ignition pulses are provided by ignitor 80. More particularly, as current flows through capacitor 92, inductor 95 and resistor 96, capacitor 92 charges to the breakover voltage of SIDAC 89.

The breakover voltage is chosen so as to correspond to the characteristic glow discharge voltage of lamp 40. In other words, the breakover voltage is chosen so as to reflect when the lamp is about to enter its steady state mode of operation.

Once the breakover voltage is reached, SIDAC 89 switches from its previous OFF-state to its ON-state. Capacitor 92 now discharges through ignitor winding 79 and SIDAC 89 resulting in a voltage pulse produced across ignitor winding 79. Through transformer action (i.e. ballast 65 acting as an autotransformer), a high voltage pulse is developed across output terminals 39, 42. The cyclical charging and discharging of capacitor 92 produces a series of high voltage pulses across output terminals 39, 42. By associating the breakover voltage of SIDAC 89 with the glow mode of lamp 40, ignition pulses are provided by ignitor 80 prior to and substantially throughout the glow mode of lamp 40. During transition from glow arc to full arc, the voltage across lamp 40 temporarily increases. Following transition into a full arc condition (discharge), the voltage across lamp 40 sufficiently drops to turn OFF SIDAC 89. Accordingly, after transition to full arc discharge, ignitor 80 is shut OFF.

SIDAC 89 serves as a voltage sensor for sensing the voltage across output terminals 39 and 42 of ballast 10. Ignitor 80, in response to SIDAC 89 cyclically turning ON and OFF, provides a sufficient amount of energy for successful takeover of lamp 40. In particular, the continuous production of ignition pulses prior to and at least substantially throughout the glow mode avoids lamp 40 remaining within the glow mode for an extended period of time. Damage of the lamp electrodes and consequent lamp destruction based on prolonged duration within the glow mode is substantially eliminated.

For example, when lamp 40 is of a metal halide type, nominally rated at 150 watts, 95 volts with SIDAC 89 having a breakover voltage of between about 110–125 volts, a voltage pulse of about 110–125 volts is applied across ignitor winding 79. A voltage of about 1800 to 3500 volts is developed across output terminals 39, 42 for starting the lamp. The SIDAC breakover of about 110–125 volts corresponds to a lamp voltage of between 150 v–200 v, respectively. The cycle of charging capacitor 92 until reaching the SIDAC breakover voltage resulting in the generation of a high voltage pulse applied to lamp 40 is repeated prior to and at least substantially throughout the glow mode of lamp 40. Ignitor 80 is shut OFF at the end of the glow mode.

More particularly, once lamp 40 is lit, the voltage across SIDAC 89 drops below its breakover voltage. Ignitor 80 is no longer able to produce a voltage pulse across ignitor winding 79. In other words, as long as lamp 40 remains lit, ignitor 80 will produce no additional voltage pulses.

In accordance with the preferred embodiment of the invention, ballast 30 is a 150 watt metal halide constant wattage autotransformer (CWA) available from Advance Transformer Company of Rosemont, Ill. as part no. 71A5486. Capacitor 66 is nominally rated at 22.5 μf, 240 volts. SIDAC 89 is available from Shindengen Electric Mfg. Co., Ltd. as Part No. K1V12 and has a nominally rated breakover voltage of about 110–125 volts. Capacitor 92 is nominally rated at about 0.33 microfarads. Lamp 40 is a high intensity discharge type, such as but not limited to, a 150 watt, 95 volt metal halide type. Inductor 96 typically includes two serial connected coils, each nominally rated at 22 millihenries. Resistor 95 is nominally rated at 3.5K ohm.

As now can be readily appreciated, the invention provides an improved ignition scheme in which ignition pulses are produced prior to and at least substantially throughout the glow mode of lamp 40. Prolonged periods of time within the glow mode are substantially eliminated by providing sufficient energy for successful takeover lamp 40.

It will thus be seen that the objects set forth above and those made apparent from the preceding description, are efficiently obtained and since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

What is claimed is:

1. A ballast for a high intensity discharge lamp having a glow mode, comprising:

output terminals for connection with a high intensity discharge lamp having a glow mode of operation, an ignitor for producing ignition pulses prior to and substantially throughout the glow mode, said ignitor having a voltage sensor for sensing the voltage across the output terminals and being responsive to the voltage sensor for producing ignition pulses whenever the voltage across the output terminals is above a predetermined value, said predetermined value being less than the voltage across the lamp when the lamp is operating in its glow mode of operation.

2. The ballast of claim 1, wherein the ignitor includes a bilateral switching device having a breakover voltage that is less than the voltage across the lamp during the lamp glow mode of operation.

3. The ballast of claim 2, wherein the ignitor includes a capacitor coupled to the bilateral switching device and through which the capacitor discharges at breakover of the bilateral switching device.

4. The ballast of claim 3, wherein the bilateral switching device is a SIDAC.

5. A lighting arrangement, comprising:

a high intensity discharge lamp having a glow mode of operation; and an ignitor for producing ignition pulses prior to and throughout the glow mode of operation of the high intensity discharge lamp, said ignitor producing ignition pulses whenever the voltage across the lamp is higher than a predetermined value, said value being less than the voltage across the lamp at all times when the lamp is operating within its glow mode of operation.

6. The lighting arrangement of claim 5, wherein the ignitor further includes a bilateral switching device having a breakover voltage that is less than the voltage across the lamp at all times during its glow mode of operation.

7. The lighting arrangement of claim 6, wherein the ignitor further includes a capacitor coupled to the bilateral switching device and through which the capacitor discharges at breakover of the bilateral switching device.

8. A method for starting a high intensity discharge lamp, comprising:

producing ignition pulses prior to the lamp entering its glow mode;

continuing to produce ignition pulses throughout the glow mode of the lamp; and discontinuing the production of ignition pulses after transition to full arc discharge of the lamp.

9. The method of claim 8, further including sensing the voltage across the lamp in determining when to produce and when to discontinue production of the ignition pulses.

* * * * *